US008492318B2

(12) United States Patent
Barbezat et al.

(10) Patent No.: US 8,492,318 B2
(45) Date of Patent: Jul. 23, 2013

(54) SPRAY MATERIAL, A THERMAL SPRAY LAYER, AS WELL AS A CYLINDER WITH A THERMAL SPRAY LAYER

(75) Inventors: Gérard Barbezat, Winterthur (CH); Peter Ernst, Stadel b. Niederglatt (CH)

(73) Assignee: Sulzer Metco AG, Wohlen (CH)

( * ) Notice: Subject to any disclaimer, the term of this patent is extended or adjusted under 35 U.S.C. 154(b) by 304 days.

(21) Appl. No.: 12/958,937

(22) Filed: Dec. 2, 2010

(65) Prior Publication Data

US 2011/0155090 A1 Jun. 30, 2011

(30) Foreign Application Priority Data

Dec. 3, 2009 (EP) ..... 09177917

(51) Int. Cl.
*C10M 103/04* (2006.01)
*C10M 103/06* (2006.01)

(52) U.S. Cl.
USPC ..... 508/103; 508/108; 508/200

(58) Field of Classification Search
USPC ..... 508/108, 103, 200
See application file for complete search history.

(56) References Cited

U.S. PATENT DOCUMENTS

| | | | | |
|---|---|---|---|---|
| 3,607,343 | A * | 9/1971 | Longo et al. | 428/404 |
| 4,256,811 | A | 3/1981 | Black | |
| 2003/0164150 | A1 | 9/2003 | Barbezat | |
| 2005/0051975 | A1 | 3/2005 | Takayama et al. | |
| 2007/0099015 | A1 | 5/2007 | Kamo et al. | |
| 2007/0298980 | A1 | 12/2007 | Takayama et al. | |

FOREIGN PATENT DOCUMENTS

| | | | |
|---|---|---|---|
| DE | 10 2004 025 672 | | 12/2004 |
| EP | 0 167 723 | | 4/1985 |
| EP | 167723 | A1 * | 1/1986 |
| EP | 1 340 834 | | 1/2003 |
| EP | 1 790 752 | | 9/2008 |
| EP | 1 970 752 | | 9/2008 |
| UA | 74 987 | | 2/2006 |
| WO | 2004/106711 | | 12/2004 |
| WO | 2011/003439 | | 1/2011 |

OTHER PUBLICATIONS

European Search Report of Aug. 3, 2010 conducted in counterpart European Patent Application No. 09177917.3-1215.

European Search Report of Apr. 9, 2010 conducted in counterpart European Patent Application No. 09177917.3-1215.

* cited by examiner

*Primary Examiner* — Jim Goloboy

(74) *Attorney, Agent, or Firm* — Greenblum & Bernstein, P.L.C.

(57) ABSTRACT

Spray material for thermally coating a substrate, a thermal spray layer, and a cylinder for a reciprocating piston combustion engine coated with the thermal spray layer. The spray material includes a solid lubricant of ZnO. A volume fraction of ZnO in the spray material lies in a range from 0.1% to 15% of the volume of the spray material.

19 Claims, No Drawings

SPRAY MATERIAL, A THERMAL SPRAY LAYER, AS WELL AS A CYLINDER WITH A THERMAL SPRAY LAYER

CROSS-REFERENCE TO RELATED APPLICATIONS

The present application claims priority under 35 U.S.C. §119(a) of European Patent Application No. 09 177 917.3 filed Dec. 3, 2009, the disclosure of which is expressly incorporated by reference herein in its entirety.

BACKGROUND OF THE INVENTION

1. Field of the Invention

Embodiments of the invention relate to a spray material for thermal coating of a substrate, in particular, for thermal coating a running surface of a cylinder of a reciprocating piston combustion engine. Embodiments of the invention also relate to a thermal spray layer, as well as to a cylinder with a thermal spray.

2. Discussion of Background Information

Coatings provided by thermal spraying have been known for a long time for a plurality of applications. Thus amongst other things, for example, surfaces of oil lubricated cylinder running surfaces of vehicle engines have been coated for some time by using plasma spraying. In particular, the layer significantly reduces the coefficient of friction between the piston rings and the cylinder wall so that the wear of the piston rings and cylinder is significantly reduced, which leads to an increased running life of the engine and an increase in the period between maintenance operations, for example, an oil change, and not least to a significant improvement of the engine performance.

This is achieved in the prior art by different measures. For example, such layers for oil lubricated combustion engines can include admixtures of solid lubricants in a basic matrix. The basic matrix can be provided with additional pores of pre-settable sizes which act as oil pockets and, together with the relatively soft admixed solid lubricants, significantly reduce the friction between the piston rings and the cylinder wall. The basic matrix itself, which among other things in particular includes the solid lubricants and the pores, is in this respect composed of a hard matrix material. The basic matrix ensures a long lifetime of the cylinder running surfaces and the piston rings. Such a modern high performance cylinder running surface is described in detail, for example, in EP 1 340 834, the disclosure of which is expressly incorporated by reference herein in its entirety.

Further typical applications for surfaces provided by thermal spraying are the coating of turbine parts with wear protection layers and thermal insulation layers of components of oil lubricated bearings, such as e.g. the coating of crankshafts or other work pieces which are subjected to particular physical, chemical or thermal loads. Depending on the function the layer has to perform, certain types of materials are used, which are generally in the form of spray powders or spray wires, which possess the required specific properties and composition, to generate the required properties of the surface layer to be sprayed.

For larger production volumes, the price of the powder material plays an important role with regard to the economic efficiency of the coating, particularly, the coating of cylinder running surfaces by the plasma spray method APS, such as in the case of coating larger engines (e.g., a diesel truck).

The production costs of the powder are dependent on the price of raw material and on the processing requirements required to work the raw materials into a viable material that is suitable for carrying out the selected method.

Utilizing the known method of gas atomization of metallic materials (by gas or water), a reduction of the energy costs can practically only be influenced by an improved powder yield. In this respect, the specification of the distribution of the particle size plays a pivotal role. Using the best conditions, the production costs of metallic powders in a quality, such as is required, e.g., for internal coating of cylinders for combustion engines, can nowadays hardly be reduced below US $ 10 per kg. For this reason, it is to be expected that a further cost reduction is subject to certain boundaries.

However, the performance requirements of the spray materials will increase with time. In particular, the tribological properties of the coating will become even more important with increased temperatures, since the effect of the lubricant significantly reduces with the increase in the wall temperature. In principle, tribological solutions that are applicable at wall temperatures of up to 350° C. are possible. In this respect, the anti-scuffing properties of the layer materials play a pivotal role.

As a cost-effective production method of, in particular, ceramic powders and/or of non-metallic powders for thermal spraying, generally grading and filtering can be used, even in the case of larger amounts of ceramic spray from metallic oxides. In the case of certain materials, minerals can be used in the powder without additional smelts taking place.

As a potential material for cylinder running surfaces, it was previously known to use iron titanate $FeTiO_3$ which is also known as ilmenite. Ilmenite is formed of approximately 53% $TiO_2$ and 47% FeO and crystallizes in a hexagonal crystal system. The hardness of ilmenite crystals is approximately 650 HV, this means that values of 400 to 500 HV are possible in the layers for optimized parameters.

For this reason an ilmenite spray material for the formation of a corrosion-resistant coating by thermal spray process was already suggested in UA 74 987, the disclosure of which is expressly incorporated by reference herein in its entirety. In WO 2004/106711, the disclosure of which is expressly incorporated by reference herein in its entirety, the applicants suggest ilmenite in part in combination with other metal ceramic materials and/or oxides as a spray material for the coating of cylinder running surfaces of supercharged engines. However, these coatings are not designed for the increased tribological requirements of highly and/or strongly fluctuating temperature loads, but primarily to improve the hardness and/or corrosion resistance of the coated surfaces.

Starting from this prior art the applicant already suggested a significantly improved spray material on an iron basis for the thermal coating of running surfaces of cylinders of reciprocating piston combustion engines with $FeTiO_3$ as a base material in PCT/EP2009/058565, the disclosure of which is expressly incorporated by reference herein in its entirety. In this respect the improved spray material in accordance with PCT/EP2009/058565 includes at least one first solid lubricant comprising sulfide and a second solid lubricant comprising fluoride.

It could be demonstrated for the first time in the above-noted application that spray materials on an iron titanate basis, i.e., on the basis of the so-called ilmenite with the chemical formula $FeTiO_3$ are particularly well suited, in particular for the thermal coating of combustion engine components, when the ilmenite is admixed with at least a sulfide and a fluoride as a solid lubricant. In this respect, the layers produced thereby are characterized, in particular, as having an excellent consistency with regards to the adhesion wear. Beside the addition of sulfide and fluoride to the solid lubricants, in particular, e.g., also additionally a nitride can be added, which among other things allows a significant increase in the wall temperature of the cylinder running surface in the operational state so that these coatings are also particularly well suited for use in adiabatic engines.

Through the simultaneous use of at least one sulfide and a fluoride in the spray material of PCT/EP2009/058565 it could be ensured that the thermally sprayed layers respectively have comparably good tribological properties for different temperature regions.

The tribological performance requirements of the iron titanate $FeTiO_3$ layers (ilmenite) can be significantly improved through the targeted addition of solid lubricants. The properties of these lubricants rely among other things on the special crystal structure and the low tendency to chemically bond and/or react with metallic and ceramic materials. The precise class of solid lubricants is selected in accordance with the invention in dependence on the expected temperature loads. In the case of cylinder inner surfaces in combustion engines, advantageously the highest wall temperature, e.g., in the contact zone between the cylinder running surface and the piston rings is considered.

The solid lubricant on a sulfide basis, for example $MoS_2$ and/or $WS_2$ can be used in an oxidized atmosphere without problems up to a temperature of 350° C. In the case of impact loads in combustion engines, the hot contact points, however, can be formed, e.g., between the cylinder running surfaces and piston rings, such that the local temperature can be significantly higher than 350° C. For this reason, at least one further type of solid lubricant is used in accordance with PCT/EP2009/058565 which has an increased temperature durability and simultaneously is also durable in the aggressive chemical conditions in the combustion space and additionally positively influences the adhesion requirements and the hardness of the coating.

In this respect, PCT/EP2009/058565 also teaches that, beside fluorides, also solid lubricants on a nitride basis, e.g., hexagonal BN or CrN, can be used particularly advantageously, as these also achieve the function of the solid lubricants up to the highest temperatures of 950° C. also under oxide conditions. Such high temperatures frequently only appear locally, for example, in cylinders of combustion engines.

In EP 1 790 752 A1, the disclosure of which is expressly incorporated by reference herein in its entirety, a thermal spray material with a very high zinc content of at least 70% zinc is suggested that can only be sprayed onto the substrate in certain low pressure conditions of less than 100 mbar, preferably also only between 1 mbar and 10 mbar gas pressure in a process chamber and maintaining very large spray distances of at least 400 mm to the substrate. In this respect, the spray material of EP 1 790 752 A1 and the therein suggested spray process serves to replace the galvanic zinc process, which is regarded as harmful to the environment, in the area of corrosion protection. For this reason, the zinc content must be at least 70% so that a sufficient effect of the zinc coating against corrosion is achieved. Due to the high vapor pressure of zinc, the spray material of EP 1 790 752 A1 can only be successfully used in combination with the low pressure method also suggested in this document, which naturally requires the use of a closed process chamber in which the required low pressure conditions are settable. For this reason the process chamber must have an adequate size so that a minimum spray distance to the substrate to be coated of at least 400 mm is settable. Furthermore, not only the pressure plays an important role in the process chamber, but a pressure ratio of approximately 1 to 40 between the pressure in the interior of the coating jet and the actual gas pressure of the gas atmosphere has to be set in the pressure chamber, i.e., the pressure within the coating jet must be larger than the pressure of the gas atmosphere in the process chamber. This selection of the pressure parameters is also referred to in the prior art as "under expanded condition". It is an essential recognition of EP 1 790 752 A1 that spray materials which include a material with a comparably high gas pressure such as, for example zinc, have to be sprayed with the method described in EP 1 790 752 A1, if it should be prevented that the material vaporizes to a high degree with the high vapor pressure on thermal spraying and therefore is no longer contained or is no longer sufficiently contained in the sprayed layer.

For this reason alone, pure zinc as a spray material additive will not be chosen by a person of ordinary skill in the art for thermal spray processes that are not carried out in a process chamber in a low pressure atmosphere, e.g., for inner coatings of cylinders with rotating spray gun. Additionally, the coatings of pure zinc do not have the required mechanical hardness and/or temperature durability for the application as cylinder running surfaces.

SUMMARY OF THE EMBODIMENTS

Embodiments of invention provide a new spray material in the form of a powder material and/or in the form of a spray wire, in particular, a spray flux cord wire for thermal coating a substrate with which thermally sprayed layers can be produced using conventional spray methods that are preferably, but not necessarily, at atmospheric pressure, that is, preferably, not at a reduced gas pressure. The thermally sprayed layer in particular have excellent tribological properties simultaneously in different temperature regions so that the powder material is in particular suitable for the formation of friction-optimized running surfaces of cylinders of reciprocating piston combustion engines which are also used in different load requirements. In this respect, the surface layers formed with this spray material should also have a sufficient corrosion resistance and have an excellent hardness and on honing the sprayed layers can simultaneously also be easily machined.

Furthermore, embodiment of the invention provide a corresponding thermal spray layer, as well as a cylinder for a reciprocating piston combustion engine coated with a thermal spray layer, which is produced using a spray material of the present invention.

Embodiments of the invention are directed to a spray material for thermal coating of a substrate. The spray material includes a solid lubricant of ZnO. A volume fraction of ZnO in the spray material lies in a range from 0.1% to 15% of the volume of the spray material.

According to embodiments, the thermal coating can include a coating of a running surface of a cylinder of a reciprocating piston combustion engine.

In accordance with other aspects of the embodiments, the volume fraction of ZnO in the spray material may be in the range from 0.5% to 12%. Further, the volume fraction of ZnO can be in the range from 4% to 12% of the volume of the spray material.

According to still other embodiments of the instant invention, the spray material can also include a carbon steel. The carbon steel may include a gas atomized carbon steel.

In accordance with further features of the embodiments, the spray material can also include a chrome steel.

According to other features, the spray material may also include TiO02.

In accordance with still further features, the spray material can also include Mo.

Moreover, the spray material can also include a ceramic material. The ceramic material except for contaminants is FeTiO3.

According to embodiments, at least one of: the ZnO can be present as ZnO powder having a presettable particle size; and the spray material can be formed by at least one of agglomeration, mixing, and cladding with the ZnO powder. The particle size of the ZnO powder may lie in a range from 1 μm to 25 μm, and preferably within a range between 5 μm and 15 μm. Further, a particle of the ZnO powder can be at least one of: mixed with at least one of a metal powder and a ceramic powder; formed by at least one of agglomeration and cladding; and at least one of mixed with a low alloy carbon steel and agglomerated. Still further, a particle of the ZnO powder may be at least one of: mixed with a powder of a corrosion resistant chrome steel; and formed by at least one of agglomeration and cladding. The corrosion resistant chrome steel can include at least one of a ferritic chrome steel and a martensitic chrome steel. Moreover, a particle of the ZnO powder can be at least one of: mixed with a ceramic powder of FeTiO3; and formed by at least one of agglomeration and cladding.

According to further embodiments of the invention, a thermal spray layer includes a spray material as described above. The thermal spray layer can be produced in one of a thermal plasma spray process and a high speed flame spray process.

In accordance with still yet another feature of the present invention, a cylinder for a reciprocating piston combustion engine coated with a thermal spray layer as described above, such that the thermal spray layer includes the spray material.

The subject matter of these embodiments is characterized by the features of the independent claims of the respective categories and the respective dependent claims relate to particular advantageous embodiments of the invention.

DETAILED DESCRIPTION OF THE EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention.

Embodiments of the invention relate to a spray material for the thermal coating of a substrate, in particular, a thermal coating of a running surface of a cylinder of a reciprocating piston combustion engine. In accordance with the embodiments, the spray material includes a solid lubricant of ZnO, in which the volume part of ZnO in the spray material lies in the region of 0.1% to 15% of the volume of the spray material.

Thus, it can be demonstrated for the first time by the present invention that spray materials including ZnO are particularly suitable for the thermal coating of combustion engine components when Zn is not in a pure form but is used as bound ZnO in the spray material and the volume part of ZnO in the spray material lies in the region of 0.1% to approximately 15% of the volume of the spray material.

The material zinc oxide ZnO has a real potential for the use as a solid lubricant, in particular in combination with thermal spray coatings due to the advantageous crystallographic and physical properties (decomposition point of ZnO is approximately 1975° C., density of ZnO is approximately 5.6/g/cm$^3$). In particular, the hexagonal crystal structure (wurtzite), the relatively low hardness (Mohs 4.5 corresponding to approximately 350 HV) and the high vapor pressure of the zinc oxide are in this respect of particular importance. For the production of thermal spray coatings, the solid lubricant ZnO is mixed, e.g., with the powder XPT-512 (low alloyed carbon steel) or agglomerated. For the effectiveness of the lubrication effect, e.g., in the application as a cylinder coating, the particle size should preferably be in a range from a few micrometers to 15 micrometers. A micro-structure is formed in the layer from alpha-Fe with fine iron carbides, wustites, FeO, magnetites, $Fe_3O_4$ and in accordance with the embodiment of the invention from zinc oxide, ZnO. The amount of ZnO in the spray material in many applications advantageously lies between 4% and 10% by volume and can, in certain cases, also lie a bit above or below this. In practice, optimization tests, e.g., by friction processes and engine test series will usually be necessary to determine the ideal amount of ZnO for the specific application. The same process can also be used with a corrosion resistant material (13 weight % chrome steel). Also, ceramic layers can be changed and/or improved by the addition of ZnO, for example, in the case of iron titanates $FeTiO_3$ (ilmenite). In particular for ceramic materials, the ease of machining on honing of the material is significantly increased by the addition of ZnO. Furthermore, the addition of zinc oxides reduces the danger of the feared scuffing for too little lubrication and the corresponding increase in local temperatures.

In this respect, the use of ZnO as an additive for thermal spray materials is of importance also from an economic point of view, since zinc oxide is automatically produced as a by product in the industrial production of brass (in foundries for the production of semi-finished products) and therefore, is very cost-effective as a raw material for the production of the spray material in accordance with the invention.

On melting of the brass alloys (for example copper with 30 to 40 weight % zinc alloy), a large amount of zinc vapor is produced namely due to the high vapor pressure of zinc. These vapors react with the oxygen in the air and thereby form particles of zinc oxide which usually have to be collected in a filter for reasons of environmental protection. The use of the zinc oxide from the filter deposits therefore makes sense not only for economic reasons, but also for reasons of environmental protection. In this respect, the frequently unavoidable contamination of zinc oxide with copper can be accepted as the properties of the solid lubricants on a zinc oxide base only plays a subordinate role so that no time-consuming and costly purification thereof is required for further processing. Essentially only a filtering of the material to the desired particle size, in which it is particularly advantageous to use an already known air screen method, is needed as preparatory operations.

In table 1 below, examples of a few particularly preferred embodiments of spray powders in accordance with the invention and the thereby produced thermally sprayed coatings are specified. In this respect, the specified micro-hardness applies to the thermal spray coatings which were applied in trials with a plasma burner of the type F210 of Sulzer Metco. These experimental results apply to ideal parameters of Ar/H2.

TABLE 1

Typical spray powder materials with additives of zinc oxide for the production of cylinder running surfaces.

| Base material | Volume % of ZnO | Particle size ZnO [micrometer] | Layer hardness HV 0.3 |
|---|---|---|---|
| Carbon steel Fe 1C 1Cr 1 Mn | 5 or 10 | 2 to 15 | 350-500 |
| Corrosion resistant steel | 10 | 5 to 20 | 350-500 |

TABLE 1-continued

Typical spray powder materials with additives of zinc oxide for the production of cylinder running surfaces.

| Base material | Volume % of ZnO | Particle size ZnO [micrometer] | Layer hardness HV 0.3 |
|---|---|---|---|
| Fe 13Cr 2Mo 0.5C Iron titanate $FeTiO_3$ | 12 | 5 to 20 | 400-600 |
| Titanium oxide (rutile) $TiO_2$ | 10 | 2 to 15 | 550-850 |

In table 2 further particularly preferred spray materials of the present invention are listed, in which simultaneously preferred embodiments from the field of automotive engineering for different engine types and load types are specified.

TABLE 2

Typical application examples of spray materials in accordance with embodiments of the invention, which have a solid lubricant with ZnO in layers on the cylinder running surfaces of reciprocating piston combustion engines.

| Engine type | Layer material | Load type | Typical applications |
|---|---|---|---|
| Gasoline engine 4 stroke | Fe 1C 1Cr 1Mn + 5 volume % ZnO | Higher rotational speeds Regular power rating Water cooled | Sports cars with automatic |
| Gasoline engine 4 stroke | Fe 1C 1Cr 1Mn + 10 volume % ZnO | Higher rotational speeds Varying power rating Water cooled | Racing engines Engines for hybrid cars |
| Diesel engine 2-4 stroke | Iron titanate $FeTiO_3$ + 12 volume % ZnO | regular rotational speeds regular power rating | Ship diesel Current generator |
| Diesel engine 4 stroke | Fe 13Cr 2Mo 0.5C + 10 volume % ZnO | Strongly varying power rating and rotational speeds | Trucks and cars |
| Gasoline engine 4 stroke | Titanium oxide (rutilee) TiO2 + 10 volume % ZnO | Very high rotational speeds, of up to more than 20000 rpm greatly varying performance and rotational speeds Water cooled | Racing engines for extreme conditions |

It can clearly be seen from table 2 in particular, that there is a relationship between the amount of ZnO which is contained in a spray material and/or in the thermally sprayed layer and the requirements on these layers in the operational state of the combustion engine. Relatively high concentrations of zinc oxide have been found to be particularly advantageous, in particular when very high thermal loads arise. High loads can mean that the engines are used at very high or greatly varying rotational speeds. Examples of this are racing engines for extreme conditions and/or for the operation of greatly varying rotational speeds and/or under strongly varying conditions. For the specific examples specified, the ZnO concentrations of approximately 10% volume percentage have been shown to be particularly advantageous here.

Higher loads can also be present for relatively uniform and/or low rotational speeds, for example, for large engines for ships or generators for the production of electrical energy with which not infrequently several thousand horse powers are produced per cylinder.

In this respect, the layers can ideally be matched through the suitable choice of the base material, e.g., Fe 1C 1Cr 1Mn, $FeTiO_3$ (ilmenite) etc. and/or through the addition of further materials such as Mo, Mn, titanium oxide or other known materials, to special requirements such as temperature changes, chemical attacks by acids, corrosion, oxidation etc. Table 2 also discloses all of these possibilities.

In particular, the tribological performance requirements of the layers in accordance with the invention can be significantly improved by the targeted addition of solid lubricants. Among other things the properties of these lubricants are due to the particular crystal structure and the small tendency to chemically bind and/or react with metallic materials and ceramic materials. The specific class of solid lubricants is chosen in accordance with the invention dependent on the different types of load to be expected. For this purpose, for example, in the case of cylinder inner coatings in combustion engines, the increased wall temperature, e.g., in the contact zone cylinder running surfaces/piston rings, is considered.

For example, solid lubricants on a sulfide basis, e.g., $MoS_2$ and/or $WS_2$, can be used in an oxidized atmosphere without problems up to a temperature of 350° C. In the case of impact loads in combustion engines, however, hot contact points can be formed, e.g., between the cylinder running surface and the piston rings, such that the local temperature can lie significantly above 350° C. Additionally, at least one further type of solid lubricant can be used for this reason, which has an increased temperature durability and is simultaneously chemically durable with regard to the aggressive chemical conditions in the combustion space and additionally positively influences the adhesion properties in the hardness of the coating.

In this respect, beside sulfides and fluorides, solid lubricants on a nitrogen basis, for example hexagonal BN or CrN, are particularly advantageous, since these achieve their function as a solid lubricant up to the highest temperatures of 950° C. also in oxidized conditions. Such high temperatures frequently only appear locally, for example, in cylinders of combustion engines.

In the specific case of application of adiabatic diesel engines, even higher local contact temperatures can be expected. Certain solid lubricants on a fluoride basis can also have the ability to ensure that lubrication also reliably takes place in these critical conditions. Thus, e.g., calcium fluoride $CaF_2$ and barium fluoride $BaF_2$ can reliably ensure the lubrication even if the locally occurring temperature is up to more than 1200° C. In this respect, it has been found that the eutecticum formed from 62 weight % $BaF_2$ and 38 weight % $CaF_2$ is particularly effective, as this ensures a significantly improved lubrication from 500° C. upward.

Advantageously the thermally sprayed layers are machined in the known manner by diamond honing following the thermal spraying.

In a particularly advantageous embodiment of the present invention, the volume fraction of ZnO in the spray material is in the range of 0.5% to 12%, preferably in the range from 4% to 12% of the volume of the spray material.

In this respect, the spray material in accordance with the embodiments in particular, e.g., a carbon steel, in particular a gas atomized carbon steel, a chrome steel, in particular, a ferritic and/or martensitic chrome steel and/or $TiO_2$ and/or Mn and/or Mo or further advantageous components can be included.

In particular to maintain a satisfactory hardness of a basic matrix of the thermally sprayed coating in accordance with the embodiments, the spray material can include a ceramic material. It is particularly preferred if the spray material of a ceramic material is $FeTiO_3$ except for contaminants.

In dependence on the thermal spray method used and in dependence on the structure which a thermally sprayed layer has to have in respect of the desired application, the ZnO can be present in the spray material as a ZnO powder with a pre-settable particle size and/or the spray material can be formed by agglomeration and/or by mixing with the ZnO powder.

As a preferred range for the particle size of the ZnO powder it has been found in this respect, that a particle size in the range between 1 μm and 25 μm, preferably in the range between 5 μm and 15 μm, is particularly advantageous.

In another embodiment particularly relevant for practice, a particle of the ZnO powder is also mixed with a metal powder and/or a ceramic powder and/or a particle of the ZnO powder can be agglomerated and/or a particle of the ZnO powder is mixed with a powder of low alloy carbon steel and/or is agglomerated.

It is self-explanatory that it is also possible that a particle of the ZnO powder is either partially or totally surrounded by a metallic powder, i.e., that it is encased either totally or partially, which is also known to the person of ordinary skill in the art as cladding.

It can be understood that for very specific applications also mixtures of the previously mentioned powder preparations are possible.

In further embodiments particularly relevant for practice, a particle of the ZnO powder is mixed with a corrosion-resistant chrome steel and/or is mixed with a ceramic powder of $FeTiO_3$ and/or is agglomerated and/or is encased.

It is particularly preferred if a thermal spray layer is produced from a spray material of the present invention in a thermal plasma spray process or in a flame spray process, in particular with a high speed flame spray process (HVOF-method). The thermal spray material is preferably used as a powder but can also be used in the form of a spray wire, in particularly in the form of a flux cord wire.

As has already been frequently mentioned, the embodiments of the invention also relate to a cylinder for a reciprocating piston combustion engine which is coated with a thermal spray layer manufactured from a spray material of the present invention.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and/or embodiments, the present invention is not intended to be limited to the particulars disclosed herein; rather, the present invention extends to all functionally equivalent structures, methods and uses, such as are within the scope of the appended claims.

What is claimed:

1. A spray material for thermal coating of a substrate, comprising:

a solid lubricant of ZnO; and a carbon steel, wherein a volume fraction of ZnO in the spray material lies in a range from 0.1% to 15% of the volume of the spray material, and the carbon steel comprises a gas atomized carbon steel.

2. The spray material in accordance with claim 1, wherein the thermal coating comprises a coating of a running surface of a cylinder of a reciprocating piston combustion engine.

3. The spray material in accordance with claim 1, wherein the volume fraction of ZnO in the spray material is in the range from 0.5% to 12%.

4. The spray material in accordance with claim 1, wherein the volume fraction of ZnO is in the range from 4% to 12% of the volume of the spray material.

5. The spray material in accordance claim 1, further comprising a chrome steel.

6. The spray material in accordance with claim 1, further comprising $TiO_2$.

7. The spray material in accordance with claim 1, further comprising Mo.

8. The spray material in accordance with claim 1, further comprising a ceramic material.

9. The spray material in accordance with claim 8, wherein the ceramic material except for contaminants is $FeTiO_3$.

10. The spray material in accordance with claim 1, wherein at least one of:

the ZnO is present as ZnO powder having a presettable particle size; and the spray material is formed by at least one of agglomeration, mixing, and cladding with the ZnO powder.

11. The spray material in accordance with claim 10, wherein the particle size of the ZnO powder lies in a range from 1 μm to 25 μm.

12. The spray material in accordance with claim 10, wherein the particle size of the ZnO powder lies in the range between 5 μm and 15 μm.

13. The spray material in accordance with claim 10, wherein a particle of the ZnO powder is at least one of:

mixed with at least one of a metal powder and a ceramic powder.

formed by at least one of agglomeration and cladding; and at least one of mixed with a low alloy carbon steel and agglomerated.

14. The spray material in accordance with claim 10, wherein a particle of the ZnO powder is at least one of:

mixed with a powder of a corrosion resistant chrome steel; and formed by at least one of agglomeration and cladding.

15. The spray material in accordance with claim 14, wherein the corrosion resistant chrome steel comprises at least one of a ferritic chrome steel and a martensitic chrome steel.

16. The spray material in accordance with claim 10, wherein a particle of the ZnO powder is at least one of:

mixed with a ceramic powder of $FeTiO_3$; and formed by at least one of agglomeration and cladding.

17. A thermal spray layer comprising a spray material in accordance with claim 1, wherein the thermal spray layer is produced in one of a thermal plasma spray process and a high speed flame spray process.

18. A cylinder for a reciprocating piston combustion engine coated with a thermal spray layer in accordance with claim 17, wherein the thermal spray layer comprises the spray material.

19. A spray material for thermal coating of a substrate, comprising:

a solid lubricant of ZnO; and a ceramic material, wherein a volume fraction of ZnO in the spray material lies in a range from 0.1% to 15% of the volume of the spray material, and the ceramic material except for contaminants is $FeTiO_3$.

* * * * *